United States Patent [19]

Wuethrich

[11] Patent Number: 4,687,089

[45] Date of Patent: Aug. 18, 1987

[54] COIN STORAGE BOX AND AUTOMATIC TELLER

[75] Inventor: Werner Wuethrich, Gümligen, Switzerland

[73] Assignee: Autelca AG., Gumligen, Switzerland

[21] Appl. No.: 769,392

[22] Filed: Aug. 26, 1985

[30] Foreign Application Priority Data

Aug. 29, 1984 [CH] Switzerland ..... 4133/84
May 1, 1985 [CH] Switzerland ..... 1840/85

[51] Int. Cl.[4] ..... G07F 5/10; G07F 9/06; G07F 3/04; G07F 1/04

[52] U.S. Cl. ..... 194/230; 194/234; 194/239; 194/243; 194/344; 194/346; 453/9; 453/53

[58] Field of Search ..... 194/229, 230, 231, 232, 194/233, 234, 239, 243, 342, 343, 344, 346, 347; 133/1 A, 8 A, 8 B, 8 D, 3 D, 3 G, 5 R, 1 R, 8 R; 221/270, 271, 279; 414/118

[56] References Cited

U.S. PATENT DOCUMENTS

| | | | |
|---|---|---|---|
| 73,911 | 1/1868 | Meaker | 133/3 D |
| 1,274,615 | 8/1918 | Sherwood | 133/1 A X |
| 3,401,704 | 9/1968 | Jullien-Davin | 133/5 R |
| 3,827,582 | 8/1974 | Lederer | 133/1 A X |
| 3,844,297 | 10/1974 | Lautzenhiser | 133/1 A |
| 4,068,752 | 1/1978 | Martin | 194/346 |
| 4,089,400 | 5/1978 | Gregory, Jr. | 194/346 X |
| 4,095,607 | 6/1978 | Newton et al. | 133/1 A |
| 4,155,437 | 5/1979 | Tojza et al. | 194/231 |

FOREIGN PATENT DOCUMENTS

| | | |
|---|---|---|
| 2266229 | 10/1975 | France . |
| 0129805 | 10/1950 | Sweden . |

*Primary Examiner*—Robert J. Spar
*Assistant Examiner*—Jay I. Alexander
*Attorney, Agent, or Firm*—Brady, O'Boyle & Gates

[57] ABSTRACT

In the stacking chamber (9) of a stacking box (50) for superimposed coins (2, 3), a stack carrier (11) supporting the stacked coins is arranged, the top surface (18) of which is inclined with respect to the horizontal (c). For the stacking of coins, the stack carrier (11) is lowered so that the uppermost (3) of the stacked coins (2, 3) is in each case closely below the upper stacking box rim (19). For issuing coins, the stack carrier (11) is lifted, during which step respectively the uppermost (3) of the coins (2, 3) stacked in an oblique position slides along the coin lying therebelow and downwards over the upper stacking box rim once this uppermost coin has been lifted above this rim.

14 Claims, 11 Drawing Figures

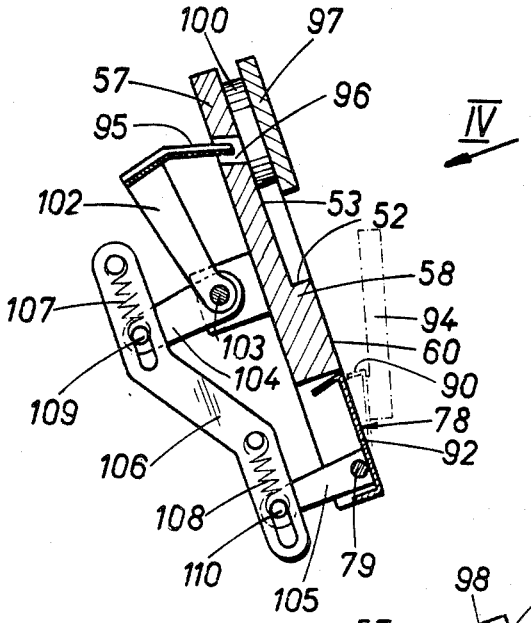
FIG. 8
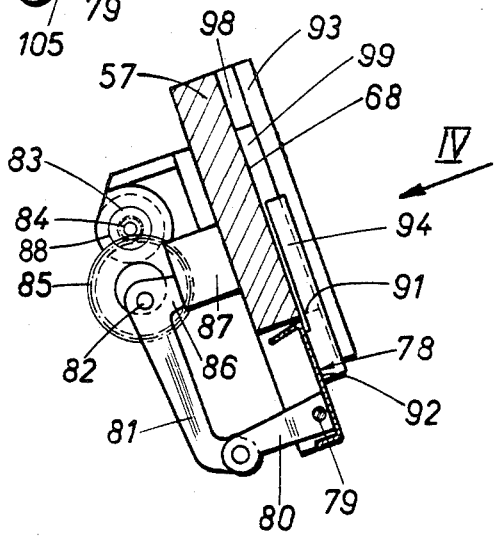
FIG. 9
FIG. 10
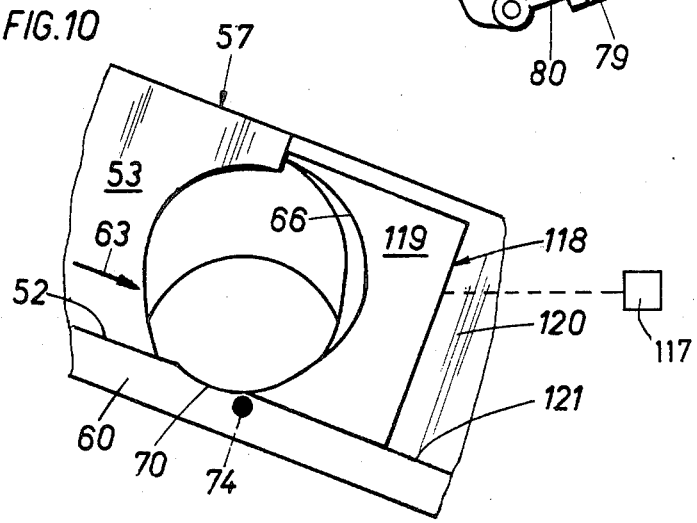

COIN STORAGE BOX AND AUTOMATIC TELLER

The invention relates to a coin storage box with an upright stacking box for superimposed coins and to an automatic teller comprising the coin storage box, or several such coin storage boxes.

BACKGROUND OF THE INVENTION

Stacking boxes of this type are known in the form of vertically disposed stacking tubes for coins. In these, the coins are stacked on top of the lower, horizontal stacking tube bottom. A slide is displaceable along the stacking tube bottom, making it possible to push the respectively lowermost coin out through a slot in the tube jacket. The conventional stacking tubes are only suited for coins of identical dimensions (diameter and thickness) and are trouble-prone during stacking as well as issuing of stacked coins. It is unavoidable that a coin that has dropped for stacking into the stacking tube occasionally remains standing, or stuck, in the stacking tube in a more or less steep position and thereby prevents a proper continuance of the stacking process.

If the coin is standing on the stacking tube bottom, it can, at best, be positioned to assume the proper, prone disposition during the subsequent slide advance. However, there is no certainty that the coins located thereabove will follow suit. In any event, during this slide advance, no coin will be ejected whereby the programmed operation of the automat is disturbed. Bent, dirty, or excessively thick coins, but also foreign bodies can block the slide. In such a case, the entire apparatus is no longer operable; the stacking tube would finally "run over". It must be emptied in a cumbersome fashion and, for this purpose, must in most cases even be taken out of the machine. Another disadvantage in the conventional stacking tubes is furthermore that respectively the lowermost coin is issued, rather than the uppermost, last-stacked coin, because it is thus possible, with use in a coin machine, to exchange low-value coins or metallic articles (insofar as they pass a provided coin test) into more valuable coins. Construction of the automatic teller is made difficult by the fact that the coin feed station is at the upper end of the stacking tube, and the coin dispensing station is at the lower end of the stacking tube. Coin machines having a low structural height cannot be provided for practical usage.

SUMMARY OF THE INVENTION

The invention is intended to offer a remedy in this context. The invention, as characterized in the claims, attains the objective of providing a coin storage box wherein even coins of differing diameters can be stacked without trouble superimposed in the desired position, and from which the stacked coins, even if they are bent, dirty, or of differing thickness, are issued without disturbances. In this connection, the present solution also achieves the results that the coin feed station and the coin issue station of the coin storage box lie at the same level, that the last-inserted coin or coins is or are issued during coin dispensing, and that the coin storage box is even self-cleaning in that foreign bodies that have entered, but also coins which, as an exception, are not in the proper position or even have jammed, are ejected upon lifting of the stack carrier in exactly the same fashion as properly stacked coins.

The automatic teller of the present invention comprises a guide means, especially adapted to the coin storage box, for the coins to be stored and for the coins issued by the coin storage box and the coins not to be stored thereby. At this coin guide means, foreign bodies are separated even before reaching the coin storage box, so that the coin feed cannot be clogged by misuse.

The advantages achieved by the invention are to be seen in essence, first of all, in that the coins are stacked in an oblique position. Each coin to be stacked slides along the inclined surface of the stack carrier and/or of the last-stacked coin until its lowest-positioned circumferential portion abuts against the wall of the stacking box. In this arrangement, the inside cross section of the stacking box can be dimensioned to be so much larger than the circular area of the coins that a coin even under adverse circumstances cannot get stuck in the stacking box. In spite of this, the coins are stacked one above the other in an orderly fashion, because they all slide obliquely downwards as far as possible. This also holds true for coins of differing diameters so that even those can be stacked in perfect superposition in the same stacking box, insofar as the smallest diameter is adequately larger than half the largest diameter. When the stack carrier is lifted to dispense coins, thick, thin, bent, or dirty coins and likewise foreign bodies as well slide over the top rim of the stacking box. During lifting of the stack carrier, the drive mechanism of the latter requires very little energy if the stack carrier is supported by a correspondingly dimensioned and pretensioned spring. By means of a coin detector, arranged directly below the top rim of the stacking box, and by means of a control device for the drive mechanisms of the stack carrier, the objective can be attained that the top surface of the uppermost, stacked coin lies, independently of its thickness (or, alternatively, with the stacking box being empty, the top surface of the stack carrier), within the plane, or so little below the plane of the top rim of the stacking box that each introduced coin traverses practically no dropping distance in the stacking box. A reliable coin feed to the stacking box is attained by having the coins to be stacked roll along an incline while sliding along an inclined guide wall, which latter has an opening arranged beside the top rim of the stacking box through which each coin to be stacked passes into contact with the uppermost, stacked coin (or, alternatively, the top surface of the stack carrier). In total, the coin storage box and the auomatic teller having one or several of such coin storage box or boxes, are distinguished by the capability of stacking in combination coins of varying diameters and thicknesses, of avoiding disturbances, for example by foreign bodies or bent coins and/or eliminating such disturbances on their own during normal operating processes, and of making do with a small amount of driving energy, and they are further distinguished by a simple, economical construction, wherein the automat can be designed with a low structural height.

BRIEF DESCRIPTION OF THE DRAWINGS

The invention will be described in greater detail below with reference of the drawings which show merely two embodiments. In the drawings:

FIG. 8 is a section along line VIII—VIII in FIG. 6, FIG. 9 is a section along line IX—IX in FIG. 6, FIG. 10 is a modification of a part of FIG. 6.

DESCRIPTION OF THE PREFERRED EMBODIMENTS

Figure 1:
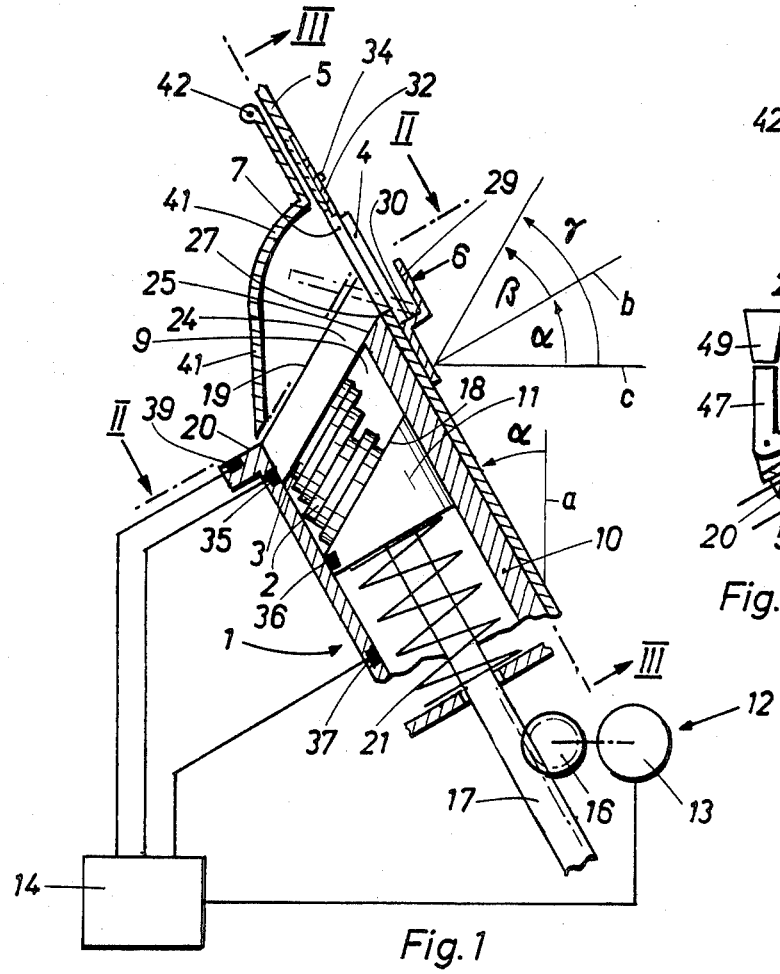
FIG. 1 shows a section through a coin storage box and a coin guide of a module of a first embodiment for an automatic teller.
Figure 2:
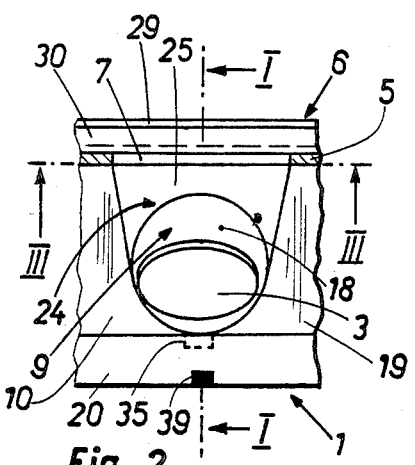
FIG. 2 is a top view along line II—II in FIG. 1.
Figure 3:
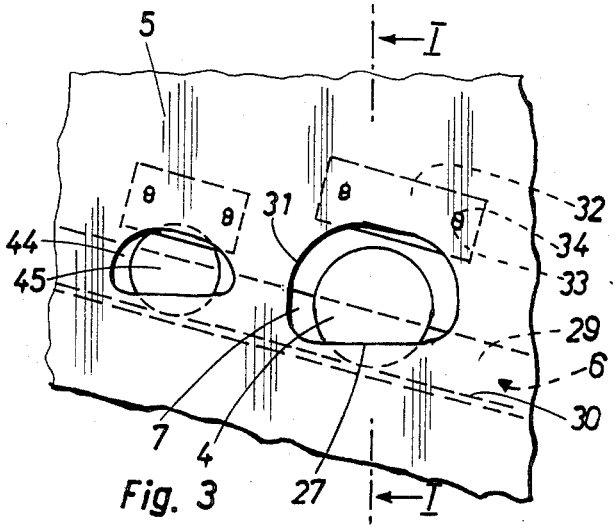
FIG. 3 is a lateral view along line III—III in FIGS. 1 and 2.
Figure 4:
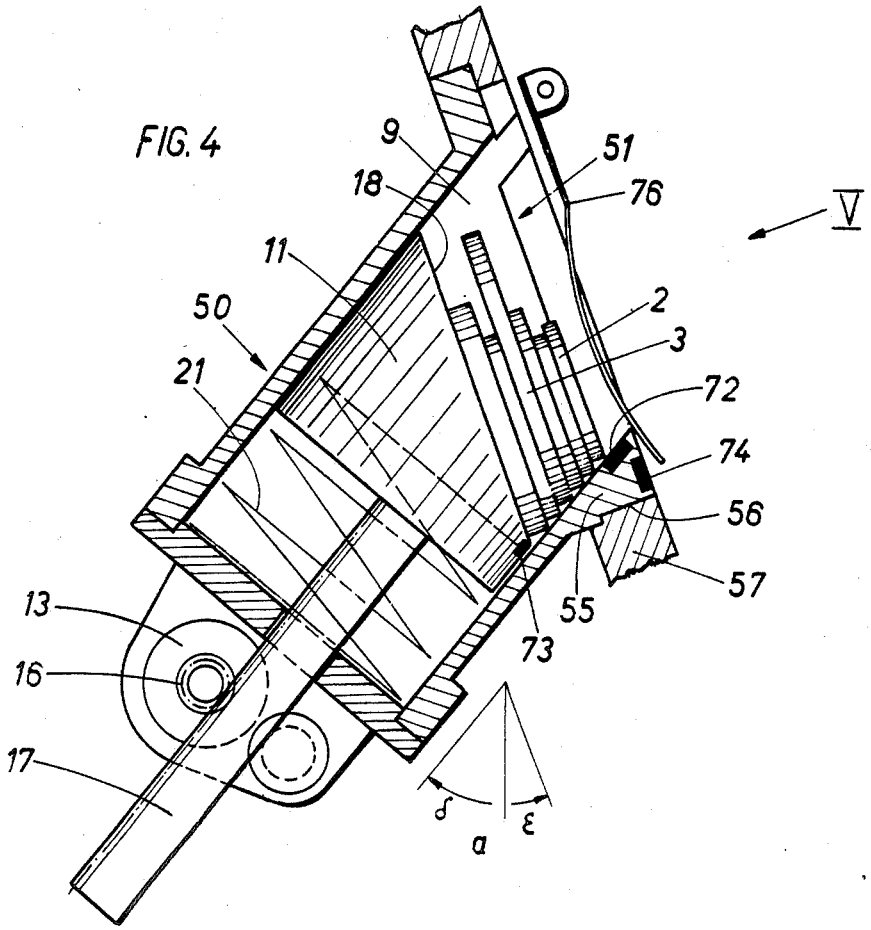
FIG. 4 is a cross section through a module of a second embodiment of the auomatic teller (section IV—IV in FIG. 6)

FIGS. 1-3 illustrate a module for an automatic teller consisting in its basic structure of stacking boxes 1, open at the top, for superimposed coins 2, 3, of which boxes only one is illustrated, and of a feeding device for the coins 4, 45 to be stacked, this feeding device comprising a guide wall 5 with a rolling track 30 formed at a guide rail 6 for the coins 4 to be stacked, the coins dropping through an opening 7 of the guide wall 5 into the stacking box 1.

The hollow chamber 9 of the stacking box 1 is formed by a bore in a synthetic resin block 10 (FIG. 2), but its cross section is not necessarily circular. The stacking box 1 is arranged in an oblique disposition, in FIG. 1 inclined in the counterclockwise direction by the angle alpha with respect to the vertical.

A piston 11 consisting of a synthetic resin, constituting a stack carrier supporting the stacked coins 2, 3, is displaceably arranged in the stacking box cavity 9 and is secured against rotation in a manner not illustrated. A drive mechanism 12 for the piston 11 includes a reversible gear motor 13 regulated by a control device 14 and driving a gear wheel 16 engaging a portion of the piston rod 17 fashioned as a rack. The top end face 18 of the piston 11 is inclined in the counterclockwise direction with respect to the cross-sectional plane b of the stacking box 1 by an angle beta so that this end face is inclined, based on the horizontal c, in this direction by an angle gamma=alpha+beta. This angle gamma is dimensioned so that, in the stacking box 1, each coin slides downwardly on the top piston surface 18 and/or on the uppermost of the already stacked coins until it abuts, in its lowest-possible position, the inner surface of the stacking box 1. With this inclination of the top piston end face 18, a coin, raised by lifting the piston 11 over the top end face 19 of the stacking box 1, slides on the coin disposed thereunder and/or on the top piston end face 18 and past the rim portion 20 of the stacking box in the downward direction. For example, alpha=-beta=30°, making gamma=60°.

The piston 11 is supported by a fixedly mounted spring 21 which is dimensioned so that its spring force increases by the amount of force exerted by the weight of a stacked coin 2, 3 on the piston 11 in the displacement direction of the latter, when the piston 11 is shifted downwards by the distance corresponding to the thickness of the coin and, respectively, decreases when the piston is shifted upwards by this distance. The pretensioning of the spring 21 is adjusted so that, in a middle position of the piston 11, the spring force is oppositely equal to the force with which the weight of the piston 11, of the piston rod 17, and of the coins 2, 3 supported by the piston 11 acts in the displacement direction of the piston 11. The forces with which the aforementioned weights act in the displacement direction of the piston 11 are the components of the force of gravity lying in the displacement direction, By the thus-dimensioned and pretensioned spring 21, the objective is attained that the gear motor 13, for lifting the piston 11 with the coins 2, 3 stacked thereon, practically needs only to overcome the occurring friction forces, independently of the number of stacked coins 2, 3. For stacking coins of different sizes, average values of coin weight and of coin thickness must be the basis for dimensioning the spring 21 and its pretensioning.

The top end face 19 of the stacking box 1 and/or of the synthetic resin block 10 is in parallel to the top surface 18 of the piston 11. The portion of the end face 19 that is higher on account of its inclination is provided with an indentation 24, the bottom surface 25 of which is in parallel to the top piston surface 18 and extends from the stacking box cavity 9 up to the lower horizontal rim 27 of the opening 7 of the guide wall 5 for coins 4 to be stacked, this wall being arranged directly beside the stacking box 1 and being inclined in the same direction as the latter. On the side of the guide wall 5 facing away from the stacking box 1, the guide rail 6 with an incline is located, this guide rail supporting the coins 4 laterally resting against the guide wall 5 at a spacing from the lower rim 27 of the opening 7 that is smaller than half the coin diameter. This spacing, the inclination of the guide wall 5, and the gradient of the guide rail 6 are dimensioned so that the coins 4 to be stacked roll within the guide rail 6 and during this step slide along the guide wall 5 so that a coin no longer supported laterally in the zone of the opening 7, as shown in dot-dash lines in FIG. 1, tips about the lower rim 27 of the opening 7 and drops onto the coin 3 that is uppermost in the coin stack 2, 3, in some cases after briefly sliding along the bottom surface 25 of the indentation 24 acting in this case as a guiding surface. The tipping process is made possible by a lateral clearance of the coins 4 in the guide rail 6, which latter comprises a lateral guide section 29 projecting upwardly past the lower rim 27 of the opening 7. The guide rail can exhibit a gradient of, for example, 20°.

The rim 31 of the opening 7 which is at the rear in the traveling direction of the coins 4 rolling along the guide rail 6 is rounded in adaptation to the coins 4. Thereby a coin 4 which is to tilt about the lower rim 27 of the opening 7 is simultaneously freed along a relatively large rim portion, and horizontal pivoting of the coin 4 is counteracted, after which the coin would no longer be in uniform contact with the lower rim 27 of the opening 7 and would no longer tip perfectly over this rim. The top rim of the opening 7 is straight and extends, at a spacing larger by a tolerance amount than the coin diameter, in parallel to the surface 30 of the guide rail 6 on which the coins 4 roll along. At a spacing from this rolling surface 30 that exceeds the coin diameter by a smaller tolerance amount, the lower rim of a shim 32 extends which is arranged in a hidden fashion at the guide surface of the guide wall 5 and is equipped with slotted holes 33 with which the shim is suspended so that it is upwardly displaceable on pins 34 mounted in the guide wall 5. This shim 32, known per se, prevents a coin, the flat dimension of which in one direction exceeds the required diameter, from jamming in the opening.

An inductive probe 35, serving as a coin detector or sensor, is disposed directly above the plane of the bottom surface 25 of indentation 24 on the side of the inner face of the stacking box 1 facing away from the guide wall 5. The probe 35 is connected to the control device 14 driving the gear motor 13 for lowering the piston 11 during the stacking of coins as long as the probe 35 responds to or sensor a coin. The probe 35 is arranged so that it ceases to respond or sense a coin once the top surface of the uppermost stacked coin 3 lies within or closely below the plane of the bottom surface 25 of the indentation 24.

For limiting the upward movement of the piston 11 during coin return, a limit switch, not shown, is provided which is connected to the control device 14 and reverses the direction of rotation of the gear motor 13 when the top surface 18 of the piston 11 surpasses the plane of the top end face 19 of the stacking box 1. During the subsequent downward movement of the piston 11, the probe or sensor 35 responds to, for example, a metal piece 36 inserted in the piston 11, whereupon the gear motor 13, similarly as during the stacking of coins, is cut off once the top piston surface 18 lies within or closely below the plane of the bottom surface 25 of the indentation 24. When the storage box 1 has been filled completely with coins, a probe or sensor 37 responds to, for example, the metal piece 36 in the piston 11 in order to trigger the processes required in this condition.

A sensor, such as an inductive probe 39 is located at the rim section 20 adjoining the deepest point of the inclined top end face 19 of the stacking box 1; this probe responds individually to the coins issued from the stacking box 1 and is connected to the control device 14 in order to stop the upward motion of the piston 11, if desired, when one coin, or a specific number of coins, has been dispensed. The thus-issued coins are conducted conventionally to a coin issue station or into a vault, depending on the position of a controllable coin switch, not shown, for example in case of a coin machine. The rim section 20 is less inclined than the top end face 19 of the stacking box which is in parallel to the upper piston surface 18. As a result, the probe 39 will reliably respond even in case a coin to be dispensed begins to slide off only after the surface of the coin lying therebelow, or of the piston 11, has been lifted past the upper stacking box end face 19.

Figure 1A:
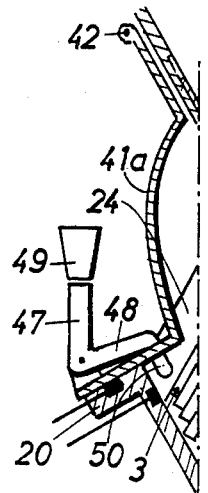
FIG 1*a* shows a modification of a detail of FIG. 1.

A cover 41 acts so that even coins which, as an exception, have not tipped with sufficient accuracy about the lower rim 27 of the opening 7 and therefore rebound in the indentation 24 and/or off the uppermost stacked coin 3, will pass into the stacking tube 1. The cover 41 is connected to the guide wall 5 by means of a pivot connection 42 and can leave a gap in the rest position, through which the coins can be issued, or it can immediately adjoin the top end face 19 of the stacking box 1 during coin stacking and can be lifted for the issuance of coins. For this purpose, a separate moving means, controlled by the control device 14; a friction rod moved jointly with the piston 11 together with a stop limiting the lifting of the cover 41; or the mechanism shown in FIG. 1*a* with the two-armed angle lever 47, 48 can be utilized, this lever being supported on the cover 41*a*. In the illustrated rest position, the lever arm 47 is vertical and is prevented from upward movement by a stop 49. In this position, the other arm 48 rests on the cover 41*a* and extends with a finger 50 into the hollow space 9 of the stacking box in such a way that it does not impede coin stacking. During lifting of the stack carrier 11, the uppermost coin 3 of the stacked coins first abuts against the finger 50. During this step, the lever 47, 48 is swung about, its arm 47 and thus also the cover 41*a* no longer being prevented from upward movement. Thereafter, the uppermost coin 3 abuts the cover 41*a*. The latter is lifted until the uppermost coin 3 slides down along the coin lying therebelow and over the stacking box rim 20. It has been found that the cover 41*a*, if designed as a lightweight part, practically does not impede the downward sliding of the coin. Inasmuch as the cover during this step executes a pendulating motion, the force with which it tends to return into its rest position is small.

In FIG. 3, the guide wall 5 is provided with a second opening 44, corresponding to the opening 7 but dimensioned for smaller coins; this opening 44 pertains to a stacking box, not shown, designed and equipped in correspondence with the stacking box 1 but dimensioned for the smaller coins. It can also be seen from this figure that the smallest of the coins to be stacked in the stacking box 1, one of these being denoted by 45, is supported by the guide wall 5, while traveling past this opening 44, above its upper rim, so that it cannot drop through this opening 44 into the other stacking box, not shown.

The dimensioning rules indicated in the description apply, if coins of differing diameters are to be stacked, analogously to the largest and smallest diameter of these coins, respectively. The stacking box 1, rectangular on the outside, with a cylindrical stacking chamber 9, can be manufactured in a simple way and is more easily assembled than a stacking tube. However, the cross section of the stacking chamber is not necessarily circular but rather can also have a different configuration suitable for supporting the coins in their oblique position on two mutually opposed locations. The stacking box could also be disposed vertically instead of obliquely, and, with the stacking box in an inclined position, the top surface of the piston could also extend perpendicularly to its shifting direction, if it leads to an adequately steep inclined position of the stacked coins. In the illustrated embodiment, in a constructionally simple way, an inclination of the top piston surface, sufficient even for poorly sliding coins, is achieved, with a lesser inclination of the stacking box 1. This lesser inclination ensures that the stacked coins reliably follow a downward movement of the piston. This also holds true analogously for the second embodiment which will be described below.

The module of an automatic teller illustrated in FIGS. 4–9, and the version according to FIG. 10, consist in their basic structure of an obliquely disposed stacking box 50 for coins 2, 3 and a coin feeding means which conducts the coins to be stacked to the stacking box opening 51 and comprises a rolling track 52 with a gradient as well as a steep guide surface 53 laterally slidingly guiding the coins rolling therealong.

The stacking box 50 corresponds, except for the configuration of its opening 51, to the stacking box 1 of FIG. 1, the corresponding components bearing the same reference numerals 2, 3, 9, 11–13, 16–18, and 21. The stacking box 50 is inclined with respect to the vertical a by an acute angle delta. The top end face 18 of the piston 11 forming the stack carrier is inclined with respect to the vertical a in the direction opposite to the inclination of the stacking box 50 by a likewise acute angle epsilon. The stacking box is cut off at the top in parallel to the top piston end surface 18 and is provided with a flange 55 seated in an opening 56 of a wall 57. A portion of the side of this wall 57 facing away from the stacking box 50 constitutes the guide surface 53 (FIGS. 6, 8, and 9), and the rolling track 52 is formed on this side of the wall 57 by a projecting step 58 (FIG. 8).

The inclination of the stacking box 50, the incline of the upper piston end face 18 and of the guide surface 53, as well as the gradient of the roller track 52 are dimensioned so that the coins to be stacked roll along the rolling track 52 while sliding on the guide surface 53, and so that the coins stacked in the stacking box 50 follow, during lowering of the piston 11, the latter with a minimum of friction, and so that a coin pushed by lifting the piston 11 transversely past the rolling track 52 will slide downwards along the coin stacked therebelow and/or along the top piston end face 18 and along the surface area 60 of the wall 57 in parallel to the guide surface and continuing the step 58 in the downward direction. By the inclination of the top piston end face 18, the result is furthermore achieved that each stacked coin will abut, with a lower marginal portion, against the wall of the stacking box 50. For this purpose, for example, delta=40° and epsilon=20°.

The rolling track 52 has an initial section adjoining the dropping path 62 (FIG. 6) of inserted coins with a gradient serving for delaying the coins and greatly diminishing in the travel direction 63 of the coins. A linear section follows this section leading to the lowermost point of the rim of the stacking box opening 51. The coils, not shown, of an inductive coin checker, likewise not illustrated, are arranged along the linear section, the testing result of this coin tester controlling the piston drive mechanism 13.

Figure 6:
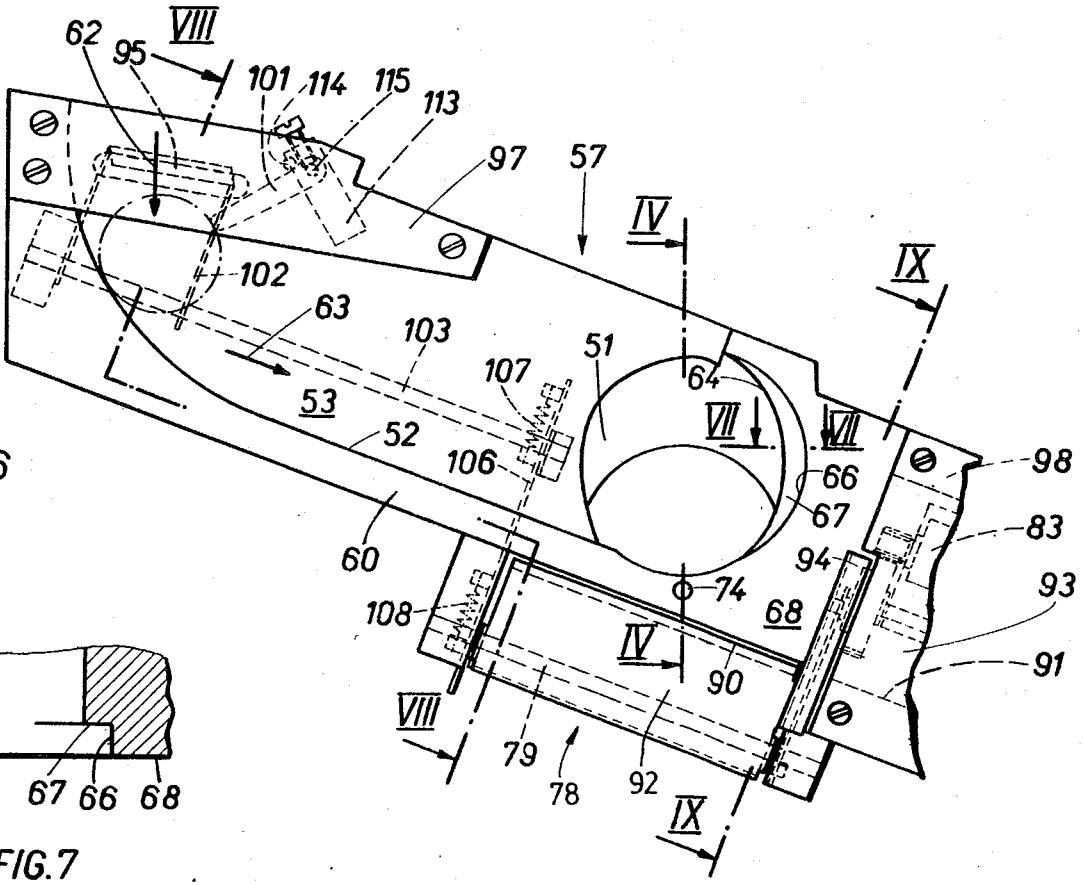
FIG. 6 is a view along line VI—VI in FIG. 4 on a reduced scale.
Figure 7:
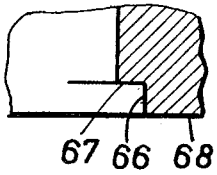
FIG. 7 is a section along line VII—VII in FIG. 6.

A catching and braking element is arranged at the portion 64 of the rim of the stacking box opening 51 which is at the front as seen in the coin travel direction 63. This catching on braking element is provided to prevent the coin to be stacked from continuing its rolling. The element is formed by an extension 66 of the rolling track 52 extending arcuately beside this rim portion 64 and being offset radially toward the outside with respect to the stacking box opening 51. The surface of the wall 57 extending between this rim portion 64 and the rolling track extension 66 forms a narrow, crescent-shaped guide surface 67 laterally guiding the coin which rolls upwardly along the rolling track extension 66; this crescent-shaped guide surface is disposed in the plane of the guide surface 53. In this arrangement, this coin is additionally guided along the outside of the last-stacked coin, lying in the plane of the guide surfaces 53 and 67 or, alternatively, if the stacking box is empty, along the upper end face 18 of the piston. The surface 68 of the wall 57 adjoining the roller track extension 66 lies in the plane of the surface 60 continuing the step 58 (FIGS. 6 and 8).

Figure 5:
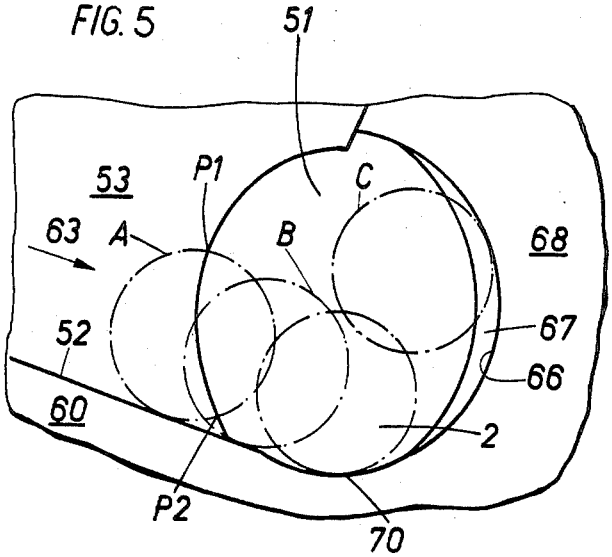
FIG. 5 is a fragmentary view in the direction V in FIG. 4, with various positions of a coin.

As shown in FIG. 5, the result can be achieved that an arriving coin, even if substantially smaller than the stacking box opening 51, and even if one or several coins of the same small size have just been stacked last, is slidingly guided laterally in front of the stacking box opening 51 so that it cannot drop into the portion of the stacking box cavity 9 which is vacant beside the stacked coins. The coin A arriving on the rolling track 52 first slides only along the guide surface 53, then the coin A slides—before it could tilt about the line P1–P2—along the guide surface 53 as well as along a part of the upper surface of the last-stacked coin 2. When the coin A reaches position B, i.e. before entirely surpassing the arc P1–P2, it slides already along more than half of the upper surface of the last-stacked coin 2 and subsequently, in its position C, it slides partially along this coin surface 2 and partially along the guide surface 67. The coin then rolls back along the rolling track extension 66 and is arrested in front of the center of the lower part of the stacking box opening 51 where the rolling track 52 has a short, concavely extending section 70 in order to steady the coin at that location. The rolling track extension 66 has the advantage that the coin does not rebound, as it would against a stop, but rather loses its kinetic energy by rolling up and down, which procedure is repeated if necessary.

A sensor, such as an inductive probe 72 (FIG. 4) is arranged on the inner surface of the stacking box 50 directly beside the lowest point of the stacking box opening 51 in the box flange 55 in a hidden fashion. The probe 72 cooperates with a control device, not shown, for the motor 13 in order to terminate the downward motion of the piston 11 during coin stacking once the upper surface of the uppermost coin lies in the plane of the guide surface 53 and/or once, after issuance of all stacked coins, the upper end face 18 of the piston lies in this plane. In order to make the probe 72 respond to the piston 11 (made of a synthetic resin) in the same way as to a coin, a metal piece 73 is inserted in the piston 11 which can additionally cooperate, for limiting the downward motion of the piston 11, with another sensor or probe, not illustrated (compare 37 in FIG. 1). Another sensor probe 74 is arranged in a hidden fashion below the stacking box opening 51 on the surface of the flange 55 lying in the plane of the wall surface 53. This probe in each case transmits a signal to a control device, not shown, when a coin slides downwards along this surface.

A readily pivotable lid 76 can be arranged in front of the stacking box opening 51; this lid, in the rest position, abuts against the rim of the rolling track section 70 facing away from the guide surface 53 and is convex in a direction toward the stacking box 50, the lid 76 also being capable of acting as a brake.

A switch member 78 of a coin switch (FIGS. 6, 8, and 9) is located underneath the stacking box opening 51 below the lower rim of the wall 57; this switch member is supported to be swingable about an axle 79 and can be pivoted into two switching positions by means of a crank gear 80–87 (FIG. 9); compare FIGS. 6, 8, and 9. In the first switching position shown in dot-dash lines in FIG. 8, a top surface 90 of the switch member 78 forms an initial section of a second rolling track 91, in parallel to the linear section of the rolling track 52, associated with the surface 68 as the guide surface for the coins rolling along this rolling track 91, and with a cover 93. In the second switching position, shown in solid lines in FIGS. 8 and 9, a lateral surface 92 of the switch member 78 lies in the plane of the surfaces 60 and 68 of the wall 57. When a coin lying at the stacking box opening 51 on the top surface of a coin 2 stacked before this coin, and/or on the top piston surface 18 is pushed, by lifting the piston 11, transversely across the roller track section 70 and past the latter, it slides along the surface 60 of the wall 57 in the downward direction. In the first position (shown in dot-dash lines) of the switch member 78, this coin passes to the top surface 90 of the switch member 78; it rolls therealong and furthermore on the second rolling track 91 to an issue point for returned coins, not shown. In the second position (shown in solid lines) of the switch member 78, the coin slides downwards along the lateral surface 92 of the switch member 78 and drops into a coin collecting box, not shown, which is open at the top. In this case, the switch member 78 opens up a dropping path along the inclined plane 60, 92.

The rolling track 91, the wall 57 (guide surface 68), the cover 93, and a strip 98 constitute a covered channel 99 for coins to be returned, The inlet to this coin return channel 99 is blocked off, in the second position (shown in solid lines) of the switch member 78, by means of a blocking element 94 fixedly connected to the switch member 78. In this arrangement, it is impossible to illegally obtain coins from the coin collecting box (not shown) that is open at the top, by standing the automat on its head and shaking same so that coins pass along the surface 68 into the coin return channel 99 and drop out through this channel. This is of importance if the coin machine is detachably mounted to a wall, or if it is used in a pay telephone designed as a table model.

The switch member 78 is fixedly connected with a lever 80 (FIG. 9), engaged by a connecting rod 81, the crank (crank pin 82) of which can be driven by means of a reversible motor 83 via a pair of gear wheels 84, 85 and a slip clutch 88. In each of the two dead center positions of the crank (82), an extension 86 of the connecting rod 81 abuts against a fixed stop 87.

A coin insert barrier is arranged at the dropping path 62 of inserted coins; the locking bolt 95 of this barrier extends through an opening 96 of the wall 57, see FIG. 8. A cover 97 is mounted in the zone of the insert barrier at a spacing from the surface 53 that is adapted to the largest coin thickness with clearance. The cover limits the dropping path 62 of the inserted coins 100 on the side in opposition to the surface 53; compare FIGS. 6 and 8. Transversely thereto, the dropping path 62 is defined, on the one hand, by a first portion of the rolling track 52 and, on the other hand, by an obliquely downwardly reaching lever 101 extending in between the interspace between the walls 57 and 97; this lever will be described in greater detail below.

The locking bolt 95 is attached to levers 102 mounted to the shaft 103 of the output crank 104 of a two-throw crank gear 104–110, the input crank 105 of which is fixedly joined to the switch member 78 (FIGS. 6 and 8). The pushrod 106 of this two-throw crank gear 104–110 is connected with the cranks 104 and 105 by means of swivel joints 109 and 110 displaceable against the force of a spring 107 or 108, respectively, when the locking bolt 95 is blocked. In case the locking bolt 95 is blocked in the feeding or (and) return direction, then the springs 107, 108 relax so that the switch member 78 can be driven by the switch drive mechanism 80–87 even with the insert barrier being blocked, in both directions, if the slip clutch 88 of the switch drive mechanism 80–87 is properly adjusted. The tensioned springs 107, 108 cannot adjust the switch member, turned about the axle 79 in one or the other direction, because the gear drive mechanism 84/85, having a high reduction, is self-retarding. A cause of the blockage of the locking bolt 95 can be a coin that moves past the opening 96 with advancement of the locking bolt, or that has been arrested by a foreign body previously pushed into the coin insert slot, or it can be a foreign body forced into the coin insert slot.

The coin guide means 52/53 has the advantage that foreign bodies cannot take hold on the steep guide surface 53 and on the rolling surface of the rolling track 52 which is adapted to the (largest) coin thickness with tolerance and therefore is narrow; rather, the foreign bodies drop down past the step 58 and along the wall surface 60. Consequently, the coin guide means 52/53 is self-cleaning. Disturbances due to foreign bodies adhering between the walls 57 and 97 are overcome already once a coin has been inserted or pushed into the insert slot. As soon as the foreign body has been pushed under the lower rim of the wall 97, it drops downwards along the surface 53, past the step 58, and further along the surface 60. If a foreign body should pass into the stacking box 50 in spite of this, it will be readily ejected at the time the piston 11 is lifted to empty the stacking box 50. Therefore, the above-mentioned disturbances are of a merely transient nature; they are overcome automatically by the normal operation of the coin machines.

The lever 101 (FIG. 6) is stressed by a weight 113 keeping the lever in the illustrated rest position against a stop 114. Its fulcrum 115 is in the center of the circular-arc-shaped course of the initial section of reduced gradient of the rolling track 52. In this arrangement, the spacing of the free end of the lever 101 from the rolling track 52 increases if the lever 101 is swung in the coin travel direction 63. The largest of the coins to be stored entrain the lever 101 temporarily and thereby are held against the rolling track 52 and retarded. Smaller coins normally pass through underneath the lever 101, but, if necessary, are forced by the lever to follow the rolling track 52. The functions of the lever 101 are of importance in case a coin is dropped in with great acceleration, especially if it is reflected against the rolling track 52.

In the version illustrated in FIG. 10, the rolling track extension 66 is formed on a component 118 that can be raised and lowered by a lifting means 117. In the lowered position the component 118 is recessed in the wall 57 so that its surface 119, following the rolling track 66 in the coin travel direction 63, lies in the plane of the guide surface 53 of the wall 57. The surface 120 of the wall 57, following this component 118 in the coin travel direction 63, lies in this plane; at this surface 120, a continuation 121 of the rolling track 52 is formed which begins at the indented place of the rolling track section 70. In the raised position of the component 118 wherein it projects past the plane of the guide surface 53 (i.e. in the not recessed position), the rolling track extension 66 acts as described above: A coin that has passed in front of the stacking box opening 51 is braked at the rolling track extension 66 and arrested, and can be stacked by lowering the piston 11 or pushed past the rolling track section 70 by lifting the piston 11, so that it slides along the previously stacked coin and/or along the upper piston surface 18 and further over the surface 60 and drops into the coin vault, not shown. In the lowered or recessed position of component 118, a coin that has arrived in front of the stacking box opening 51 and has optionally been braked and arrested at the rolling track extension 66, rolls without a change in direction further along on the continuation 121 of the rolling track 66, first sliding along the previously stacked coin and/or along the upper piston surface, and then along the surfaces 119 and 120, in order to finally pass to the withdrawal point, not illustrated, for returned coins. As can be seen, the coin switch with the switch member 78 and the second rolling track 91 are in this case superfluous. However, they could be additionally provided, in which case three continued conveying paths are available. In this connection, the spacing of the extension 121 of the rolling track 52 from the second rolling track 91 would have to be dimensioned to be so large that the part of the surface 60 extending therebetween suffices for the lateral guidance of the largest coins. The embodiment according to FIG. 10 can be expanded so that the continuation 121 of the rolling track 52 extends past several openings, each of which lead into a stacking box for coins, and each of which is associated with respectively one component 118.

I claim:

1. A coin storage box, especially for automatic tellers, comprising a stacking box (1, 50) having a cavity (9) with a top opening for receiving superimposed stacked coins (2, 3) in said cavity (9), a stack carrier (11) in said cavity (9) for supporting the stacked coins (2, 3), a reversible drive mechanism (12) connected to said stack carrier (11) and operative to raise and lower said stack carrier (11) within said cavity (9), a rim portion (20, 55) on said stacking box adjacent the top opening, said stack carrier (11) having an inclined top surface (18) whereby a coin that has been raised in said cavity (9) over the rim portion by raising the stack carrier (11) in said cavity (9) slides downwards along the coin lying therebelow in the stack of coins or along said inclined top surface (18) and over part of said rim portion (20, 55), coin detector means (35, 72) connected adjacent the top opening responsive to the presence of a coin in the top opening of said stacking box (1, 50), a control device (14) connected to said coin detector means (35, 72) and to said reversible drive mechanism (12), and said reversible drive mechanism (12) operative by said control device (14) to lower said stack carrier (11) during the stacking of coins thereon as long as said coin detector means (35, 72) responds to the presence of a coin in the top opening.

2. A coin storage box according to claim 1 and a top end face (19) on said stacking box (1) around the top opening, said top end face (19) having at least a portion extending around the lower circumferential half of said inclined top surface (18) of said stack carrier (11) disposed parallel to said inclined top surface (18).

3. A coin storage box, especially for automatic tellers, comprising a stacking box (1, 50) having a cavity (9) with a top opening for receiving superimposed stacked coins (2, 3) in said cavity (9), a stack carrier (11) in said cavity (9) for supporting the stacked coins (2, 3), a reversible drive mechanism (12) connected to said stack carrier (11) and operative to raise and lower said stack carrier (11) within said cavity (9), a rim portion (20, 55) on said stacking box adjacent the top opening, said stack carrier (11) having an inclined top surface (18) whereby a coin that has been raised in said cavity (9) over the rim portion by raising the stack carrier (11) in said cavity (9) slides downwards along the coin lying therebelow in the stack of coins or along said inclined top surface (18) and over part of said rim portion (20, 55), fixed support means mounted at the bottom of said stacking box (1, 50), a spring (21) connected between said fixed support means and said stack carrier (11), said reversible drive mechanism (12) including a piston rod (17) connected to said stack carrier (11) and extending through said spring (21) and said fixed support means, said spring having a spring force which increases by the amount with which the weight of a stacked coin (2, 3) acts on said stack carrier (11) in the displacement direction of the latter, when said stack carrier (11) is lowered by the distance corresponding to the thickness of the coin (2, 3), and, respectively, the spring force decreases when said stack carrier (11) is raised by this distance, and that the springiness of the spring (21) is such that in a halfway position of said stack carrier (11) in said cavity (9) between said stacking box top opening and said fixed support means, the spring force is oppositely equal to the sum of the components of the forces of gravity of the stack carrier (11) and of the piston rod (17) and of the coins (2, 3) supported in this position, said components extending in the displacement direction of said stack carrier (11).

4. A coin storage box, especially for automatic tellers, comprising a stacking box (1) having a cavity (9) with a top opening for receiving superimposed stacked coins (2, 3) in said cavity (9), a stack carrier (11) in said cavity (9) for supporting the stacked coins (2, 3), a reversible drive mechanism (12) connected to said stack carrier (11) and operative to raise and lower said stack carrier (11) within said cavity (9), a rim portion (20) on said stacking box adjacent the top opening, said stack carrier (11) having an inclined top surface (18) whereby a coin that has been raised in said cavity (9) over the rim portion by raising the stack carrier (11) in said cavity (9) slides downwards along the coin lying therebelow in the stack of coins or along said inclined top surface (18) and over part of said rim portion (20), a cover (**41*a*) pivotally connected above and closing the top opening of said stacking box (1) at least at the rim portion (20) over which the coins slide downwardly for the coin feed, said cover (41*a*) movable from a closed rest position in substantial contact with said rim portion (20) to an open position spaced from said rim portion (20), a two-arm locking lever (47, 48) pivotally connected to said cover (41*a*), stationary stop means (40) above said two-arm locking lever, one arm (47) of said two-arm locking lever being vertically disposed an positioned adjacent said stop means (49) and being blocked from upward movement by said stop means (49) to lock said cover in closed position, the other arm (48) of said two-arm locking lever having a free end, said cover (41*a*) having an opening, a finger (50) connected on the free end of said other arm (48) and extending through the opening in said cover (41*a*) into said cavity (9), whereby when said stack carrier (11) is raised said finger (50) is pushed by the uppermost coin (3) of the stacked coins (2, 3), said one arm (47) is swung away from its blocked position by said stop means (49), and thereafter said cover (41*a*) is raised to the open position by the uppermost coin (3) until the coin (3) has slid downwards along the coin lying therebelow or along said inclined top surface (18) and over one part of said rim portion (20**).

5. A coin storage box, especially for automatic tellers, comprising a stacking box (1) having a cavity (9) with a top opening for receiving superimposed stacked coins (2, 3) in said cavity (9), a stack carrier in said cavity (9) for supporting the stacked coins (2, 3), a reversible drive mechanism (12) connected to said stack carrier (11) and operative to raise and lower said stack carrier (11) within said cavity (9), a rim portion (20) on said stacking box adjacent the top opening (19), said stack carrier (11) having an inclined top surface (18) whereby a coin that has been raised in said cavity (9) over the rim portion by raising the stack carrier (11) in said cavity (9) slides downwards along the coin lying therebelow in the stack of coins or along said inclined top surface (18) and over part of said rim portion (20), an enlarged cavity portion in the form of an indentation (24) at the top end of said stacking box (1) and between the top opening (19) and the cavity (9) of the stacking box, an inclined guide wall (5) for coins (4) to be stacked connected beside the indentation (24) of the stacking box, a through opening (7) in said inclined guide wall (5), said through opening (7) having a substantially horizontal lower rim (27), a guide rail (6) connected to the side of said guide wall (5)

facing away from the stacking box (1) and spaced below said lower rim (27) of the through opening (7) by a distance smaller than half a coin diameter and supporting and guiding coins with lateral play, a bottom surface (25) in the indentation (24) extending substantially parallel with said inclined top surface (18) of said stack carrier (11) and extending from the top of cavity (9) up to said lower rim (27) of the through opening (7) and forming a sliding surface for coins, lateral faces in said indentation (24) on opposite sides of the bottom surface (25) forming lateral guides for coins, the steepness of said inclined guide wall (5) being such that coins rolling in said guide rail (6) supportively lean against and slide along said inclined guide wall (5), whereby coins arriving at the through opening (7) are no longer supported by the inclined guide wall (5) and tip about said lower rim (27) of the through opening (7), slide down said sliding surface (25) and are guided by the lateral guides and drop into the stacking box (1).

6. A coin storage box as set forth in claim 5, in which said through opening (7) in the inclined guide wall (5) is wider than the coin diameter and having a rearward rim (31), relative to the travel direction of the coins (4) to be stacked, which extends in a curved fashion in adaptation to the coin radius.

7. An automatic teller with at least one coin storage box, comprising a stacking box (10) having a cavity (9) with a top opening for receiving superimposed stacked coins (2, 3) in said cavity (9), a stack carrier (11) in said cavity (9) for supporting the stacked coins (2, 3), a reversible drive mechanism (12) connected to said stack carrier (11) and operative to raise and lower said stack carrier (11) within said cavity (9), a rim portion (55) on said stacking box adjacent the top opening, said stack carrier (11) having an inclined top surface (18) with a line of slope whereby a coin that has been raised in said cavity (9) over the rim portion by raising the stack carrier (11) in said cavity (9) slides downwards in the direction of said line of slope along the coin lying therebelow in the stack of coins or along said inclined top surface (18) and over part of said rim portion (55), a coin feeder (52, 53) including an inclined guide surface (53) and a rolling track (52) with a gradient, said guide surface (53) being approximately parallel to said inclined top surface (18) of said stack carrier (11), said rolling track (52) being formed by a step (58) projecting at said guide surface (53) and extending transversely to said line of slope of said top surface (18) of said stack carrier (11), the steepness of said guide surface (53) and the inclination of said rolling track (52) being dimensioned so that the coins roll along the rolling track (52) and, during this process, are guided with sliding friction along the guide surface (53), said coin feeder (52, 53) extending up to said top opening of said cavity (9) and is adapted to guide coins toward the top opening at least approximately parallel to said inclined top surface (18), and said rim portion (55) including an extension (66, 70) of said rolling track (52) having a first section continuing the rolling track (52) about the lower zone of the top opening of the cavity (9) and a second section (66) running upwards above the level of the rolling track (52) in an arcuate shape about that part of the stacking box top opening which opposite to said coin feeder (52, 53).

8. An automatic teller as set forth in claim 7, and said first section of said extension of said rolling track (52) has an indentation (70) at the lower zone of the top opening to steady the coin arrived at that point in the stacking position.

9. An automatic teller as set forth in claim 7, including a movable member (78) of a coin switch (78–87) which is connected underneath the top opening (51), said movable member (78) in a first switching position, forming an initial section (90) of a second rolling track (90, 91) for coins pushed, by raising the stack carrier (11), transversely past the rolling track (52) of the coin feeder (52, 53), another guide surface (68) that is at least approximately in parallel to the inclined top surface (18) connected adjacent the second rolling track (90, 91), and said movable member (78), in a second switching position, vacates a route for the downward dropping of the coins pushed by the stack carrier (11) transversely past the rolling track (52) of the coin feeder (52, 53).

10. An automatic teller as set forth in claim 7, in which said rim portion (55) also includes a supporting surface (67) connected approximately parallel to said inclined top surface (18) of said stack carrier (11) and connected between said top opening of said cavity (9) and said second section (66) of said extenstion (66, 70).

11. An automatic teller as set forth in claim 7, in which said supporting surface (67) is substantially crescent-shaped.

12. An automatic teller with at least one coin storage box, comprising a stacking box (50) having a cavity (9) with a top opening for receiving superimposed stacked coins (2, 3) in said cavity (9), a stack carrier (11) in said cavity (9) for supporting the stacked coins (2, 3), a reversible drive mechanism (12) connected to said stack carrier (11) and operative to raise and lower said stack carrier (11) within said cavity (9), a rim portion (55) on said stacking box adjacent the top opening, said stack carrier (11) having an inclined top surface (18) whereby a coin that has been raised in said cavity (9) over the rim portion by raising the stack carrier (11) in said cavity (9) slides downwards along the coin lying therebelow in the stack of coins or along said inclined top surface (18) and over part of said rim portion (55), a coin feeder (52, 53) including an inclined guide surface (53) approximately parallel to said inclined top surface (18) of said stack carrier (11) and a rolling track (52) with a gradient extending up to said top opening of said cavity (9), adapted to guide coins toward the top opening of said cavity, the steepness of said guide surface (53) and the inclination of said rolling track (52) being dimensioned so that the coins roll along the rolling track (52) and, during this process, are guided with sliding friction along said guide surface (53) at least approximately parallel to said inclined top surface (18), a movable member (78) of a coin switch (78–87) connected underneath the top opening of said cavity (9), said movable member (78) in a first switching position forming an initial section (90) of a second rolling track (90, 91) for coins pushed, by raising the stack carrier (11), transversely past said rolling track (52) of said coin feeder (52, 53), another guide surface (68) that is at least approximately in parallel to the inclined top surface (18) connected adjacent said second rolling track (90, 91), said movable member (78) in a second switching position, vacates a route for the downward dropping of the coins pushed by the stack carrier (11) transversely past said rolling track (52) of said coin feeder (52, 53), a second rolling track section (91) of said second rolling track (90, 91), said second rolling track section (91) following said movable member (78), said another guide surface (68) associated with said second rolling track section (91) comprise parts of a covered channel (91, 68, 93, 98) for coins to be returned, a blocking member (94)

connected to said movable member (78), and said covered channel having an inlet which, in the second switching position of said movable member (78), is closed by said blocking member (94).

13. An automatic teller with at least one coin storage box, comprising a stacking box (50) having a cavity (9) with a top opening for receiving superimposed stacked coins (2, 3) in said cavity (9), a stack carrier (11) in said cavity (9) for supporting the stacked coins (2, 3), a reversible drive mechanism (12) connected to said stack carrier (11) and operative to raise and lower said stack carrier (11) within said cavity (9), a rim portion (55) on said stacking box adjacent the top opening, said stack carrier (11) having an inclined top surface (18) whereby a coin that has been raised in said cavity (9) over the rim portion by raising the stack carrier (11) in said cavity (9) slides downwards along the coin lying therebelow in the stack of coins or along said inclined top surface (18) and over part of said rim portion (55), a coin feeder (52, 53) including an inclined guide surface (53) approximately parallel to said inclined top surface (18) of said stack carrier (11), and a rolling track (52) with a gradient extending up to said top opening of said cavity (9), adapted to guide coins toward the top opening of said cavity, the steepness of said guide surface ((53) and the inclination of said rolling track (52) being dimensioned so that the coins roll along the rolling track (52) and, during this process, are guided with sliding friction along said guide surface (53) at least approximately parallel to said inclined top surface (18), a movable member (78) of a coin switch (78–87) connected underneath the top opening of said cavity (9), said movable member (78) in a first switching position forming an initial section (90) of a second rolling track (90, 91) for coins pushed, by raising the stack carrier (11), transversely past said rolling track (52) is said coin feeder (52, 53), another guide surface (68) that is at least approximately in parallel to the inclined top surface (18) connected adjacent said second rolling track (90, 91), said movable member (78) in a second switching position, vacates a route for the downward dropping of the coins pushed by the stack carrier (11) transversely past said rolling track (52) of said coin feeder (52, 53), including a crank gear (79–87) connected to drive said movable member (78) between said first and second switching positions, said crank gear (79–87) including a crank (82) having two dead center positions, and in each of which positions said crank abutting against a stop (86/87), a reversible motor (83), a slip clutch connecting said crank (82) to said reversible motor (83), a coin insert barrier (95), said reversible motor (83) during movement of said movable member (78) from the second switching position into the first switching position, also moving said coin insert barrier (95) in the blocking direction, and, conversely, and at least one spring (107, 108) connected between said coin insert barrier (95) and said reversible motor (83).

14. An automatic teller with at least one coin storage box, comprising a stacking box (50) having a cavity (9) with a top opening for receiving superimposed stacked coins (2, 3) in said cavity (9), a stack carrier (11) in said cavity (9) for supporting the stacked coins (2, 3), a reversible drive mechanism (12) connected to said stack carrier (11) and operative to raise and lower said stack carrier (11) within said cavity (9), a rim portion (55) on said stacking box adjacent the top opening, said stack carrier (11) having an inclined top surface (18) whereby a coin that has been raised in said cavity (9) over the rim portion by raising the stack carrier (11) in said cavity (9) slides downwards along the coin lying therebelow in the stack of coins or along said inclined top surface (18) and over part of said rim portion (55), a coin feeder (52, 53) including an inclined guide surface (53) approximately parallel to said inclined top surface (18) of said stack carrier (11), and a rolling track (52) with a gradient extending up to said top opening of said cavity (9), adapted to guide coins toward the top opening of said cavity, a coin catching and braking device (66, 67) arranged at the end of said rolling track (52) beside said rim portion (55) and at the top opening of said cavity (9), the top opening of said cavity (9) having a circumferential half (64) on the downstream side of the opening, said coin catching and breaking device including an arcuate shaped extension (66) of said rolling track (52) extending beside at least a portion of the circumferential half (64) of the top opening, means (117) connected to lower said extension (66) of the rolling track (52) to the plane of said inclined guide surface (53) of said coin feeder (52, 53), and a coin guide means (121, 119, 120) with a second rolling track (121) following said rolling track (52) of the coin feeder (52, 53), said coin guide means including a guide surface (119, 120) lying in the plane of the inclined guide surface (53) of the coin feeder (52, 53), so that when said extension (66) of said rolling track (52) is lowered, a coin continues to roll on the coin guide means (121, 120), and when said extension (66) is not lowered a coin is intercepted and stopped at the extension (66), and upon raising of the stacked carrier (11) for the coin stack (2, 3) the stopped coin is pushed over the rolling track (52) of the coin feeder (52, 53) and drops down.

* * * * *